US005762145A

United States Patent [19]

Bennett

[11] Patent Number: 5,762,145

[45] Date of Patent: Jun. 9, 1998

[54] HIGHWAY VEHICLE FUEL TANK FIRE PROTECTION DEVICE

[76] Inventor: Joseph Michael Bennett, 5722 Craigmont Ct., Huber Heights, Ohio 45424

[21] Appl. No.: 759,864

[22] Filed: Dec. 3, 1996

[51] Int. Cl.[6] ..... A62C 3/07

[52] U.S. Cl. ..... 169/62; 169/26

[58] Field of Search ..... 169/62, 26

[56] References Cited

U.S. PATENT DOCUMENTS

| | | | |
|---|---|---|---|
| 2,911,049 | 11/1959 | Crouch | 169/62 |
| 3,698,597 | 10/1972 | Burke | 169/62 |
| 3,930,541 | 1/1976 | Bowman et al. | 169/62 |
| 4,121,666 | 10/1978 | Rozniecki | 169/62 |
| 4,132,271 | 1/1979 | Mikaila | 169/62 |
| 4,215,752 | 8/1980 | Waller | 169/62 |
| 4,251,579 | 2/1981 | Lee et al. | 169/26 |
| 4,262,749 | 4/1981 | Monte | 169/62 |

FOREIGN PATENT DOCUMENTS

| | | | |
|---|---|---|---|
| 635827 | 3/1928 | France | 169/62 |
| 1380420 | 1/1975 | United Kingdom . | |
| 1445832 | 8/1976 | United Kingdom . | |
| 1453836 | 10/1976 | United Kingdom . | |
| 1454492 | 11/1976 | United Kingdom . | |
| 1454493 | 11/1976 | United Kingdom . | |
| 1496652 | 12/1977 | United Kingdom . | |
| 1547568 | 6/1979 | United Kingdom . | |

*Primary Examiner*—Gary C. Hoge

[57] ABSTRACT

A fixed hollow panel, either channeled or unchanneled internally with extinguishant sealed inside, is mounted on the exterior surfaces of a highway vehicle fuel tank. When the vehicle on which this device is mounted is impacted in an accident, and the resultant impact deforms or ruptures the fuel tank, the attached device is also ruptured and releases the extinguishant contained inside the device. This is intended to extinguish fires or inert against potential fires in the vicinity of the fuel tank, where splashing or misting fuels may come into contact with sparks or other ignition sources for a brief instant, hence protecting against accident-induced vehicle fires in a simple, lightweight and low cost manner.

6 Claims, 1 Drawing Sheet

HIGHWAY VEHICLE FUEL TANK FIRE PROTECTION DEVICE

BACKGROUND OF THE INVENTION

1. Field of the Invention

The present Invention relates to a fire extinguisher system. More specifically, the present Invention relates to a fixed hollow panel, either channeled or unchanneled internally, with fire extinguishant sealed inside, that is mounted on the exterior surfaces of a highway vehicle fuel tank and releases the fire extinguishant contents upon impact in an accident to prevent spilt fuel from igniting into a fire.

2. Related Art

Hundreds of thousands of vehicular accidents occur each year on American highways. Many accident-related fire events occur when the region of the vehicle containing the fuel tank is impacted in an accident, spilling the fuel contents from the tank in the form of a spray, stream and eventual pool around the vehicle. The highly ignitable spray mist gienerated upon impact may be exposed to the ignition energy from the sparks generated from vehicle deformation on impact for only a fraction of a second. This duration, however, may be long enough to ignite the fuel mist into a possible explosion, or more likely a fireball that will ignite a developing pool of fuel surrounding the vehicle and create a more serious threat. In many cases the threat of ignition and resultant flame spread only exists for the instant that the sparks from the impact event remain. These events have been noted particularly on several recent automotive and truck designs that were hypothesized due to tank placement and structural design to have potentially higher rates of incidences of Such events. These high profile examples often lead to spectacular fire events and the higher rates of burn inijuries and fatalities when they occur, and have resulted in national discussions on how to prevent their continued occurance. Unfortunately most fire protection technologies are impractical for general highway vehicle use, due to their cost (both in unit cost and in installation), complexity and resultant reliability problems (due to electronic and power requirements for example), and potential substantial weight increases. As a result, very little has been done to prevent such events in the future.

The military has similar events that occur in a combat scenario. In particular, military aircraft that are impacted by anti-aircraft projectiles can develop fires in adjoining bays adjacent to fuel tanks on board aircraft. The fuel leaking or spraying fiordl a penetrated tank encounters ignition sources such as burning incendiary particles deposited by the projectile in the adjoining bay, with resultant fires threatening the inteoirity of the aircraft. Many aircraft losses in combat have been attributed to such events. As in the highway vehicle case the threat of fuel ignition typically only remains for the fraction of an instant that the incendiaries are hot enough to ignite the fuel. As a result technologies have been developed in recent decades to prevent or suppress such events for newer combat aircraft. These technologies include automatic gaseous fire extinguishing systems.

One approach to aircraft fire protection are passive systems. These systems are typically some form of structure that requires no electrical power or other artificial monitoring. These systems function by being, impinged directly by the explosion or fire event. They typically provide explosion protection inside the fuel tank or in surrounding compartmeinits around the fuel tank. One of the earliest and most successful variants was the use of flexible reticulated foam in fuel tanks to mitigate explosions. This concept was extensively used successfully in the latter stages of the Vietnam war and became a fixture on many modern era aircraft. The British military developed several advanced concepts in the early 1970s. Tihese included forming reticulated foam inlto balls to fil various compartments adjacent to fuel tanks in aircraft (U.K. Patents 1,380,420;1,445,832 and 1,454,492) that could be coated with substances that swell upon heating to cut off air supply to the fire, and filled with various gaseous and powder extinguishing agents to provide extra fire extinguishing in addition to fire mitigation. Some of these concepts could also be used in the fuel tank itself. The main advantages of such concepts were ease of installation, high reliability due to lack of sophisticated electronics and other devices, and competitive weight penalties in comparison to active fire suppression systems such as gaseous fire extinguishing and detection systems, with the trade off depending upon the compartment volume and configuration.

One major advancement in the concept of passive protection is the evolution of embedded fire extinguishants into rigid or semi-rigid panels that could be mounted onto the wall of the fuel tank adjoining and facing an adjacent bay. These panels, when impacted by a projectile penetrating through the aircraft, would rupture locally and release a portion of extinguishant into the adjacent bay, extinguishing instantly the beginnings of fuel spray from the damaged fuel tank entering the bay and igniting, or inerting against ignition when the fuel vapors come into contact with the deposited incendiary particles. These panels were developed and demonstrated with gaseous extinguishing agents and various powders (U.K. Patents 1,454,493 and 1,547,568). These panels took the form of hollow panels with cylinders or sachets of extinguishant inserted, or balls or sheets of reticulated foam (sometimes sealed in bags with a pressurized gaseous extinguishant). These panels could be parasitically added in retrofit or integrally built into the aircraft structure. All of these evolutionary improvements to the basic panels showed some level of performance enhancement for a given system volume or weight, but could be offset by increased complexity or increased material, assembly or installation cost. In full scale ballistic testing various configurations and combinations of extinguishants have demonstrated successful penetration against various threats, but their performnanice would change as conditions, threats or compartment configurations changed. The most common and simple were thin panels with a hexagonal honeycomb sandwich material of kraft paper, aluminum or Nomex, filled with a fire extinguishing powder and covered with a thin sheet on both faces of aluminum foil, composite fibers or other materials. These devices were described as "powder panels" or "powder packs". These type panels were demionstrated to effectively protect against many large ballistic incendiary threats with as little as 0.1 inch total thickness and 0.2–0.6 pounds mass per square foot. Other threats and conditions could require much thicker, heavier, systems if they worked at all. Some limitations in performance were seen against small threats which limited rupture damage to the panel and as a result limited the amount of powder extinguishant released to extinguish the fire. The weight impact of such panels, which were typically mounted on the interface wall of an aircraft fuel tank with an adjacent compartment and trimmed to overlay around existing attached equipment on the wall, depended upon the area of the protected interface, versus the volume of the compartment as is pertinent for gaseous fire extinguishing systems. The favorable conditions for either approach depends upon the compartment configuration, and both concepts are in use, although the powder panels have had more limited use. Variations of this concept were investigated for use against ballistic impacts in armored vehicles (U.S. Pat. Nos. 3,930,541 and 4,132,271), although powders were primarily limited for use in engine compartments due to the inhalation difficulties with crew members, and gaseous extinguishant filled panels were used in the crew compartment. Later fine tuning was made including adding spall shields to prevent spallation damage from the panels to crew members. Since these systems require actual impact to function, their utility and consideration was limited to combat-induced ballistic impact events; they offer no protection against gradual fuel system leakage and ignition due to ordinary and minor fuel system failures. Since weight reduction was the critical factor for military aircraft, special complex, low production prototype systems were considered for use; the considerable costs of materials, assembly and installation of such configurations and exotic extingishants were not as strong a factor. For military applications it was understood t hat the total number of units manufactured would be relatively small and costly in comparison to commercial applications as is common with specialized military equipment.

In summary, a technology is desired that can incorporate the beneficial aspects of simplicity in concept and reliable fire extinguishing and prevention upon ballistic impact-induced fuel system failures that the military-developed powder panels demonstrate while incorporating simpler and lower cost of materials, construction and installation as is necessary for commercial applications and apply such a concept to protect the fual tanks of highway vehicles from crash-induced fire events. No device has been demonstrated to date that incorporates all these features for this application.

SUMMARY OF THE INVENTION

The principal object of the present Invention is to provide a means of extinguishing or preventing fires on board highway vehicles due to crashes.

Another object of the present Invention is to provide such a system that is also lightweight and relatively small in size.

Another object of the present Invention is to provide such a system that is relatively easy to assemble and install, both for new highway vehicles in assembly and older highway vehicles for retrofit, in comparison to similar military systems.

Another object of the present Invention is to provide a system that is relatively low cost in materials, manufacture and installation as compared to similar military systems.

The foregoing objects can be accomplished by providing a parasitic or integral structure attached to or surrounding, the fuel tank, comprising two flat sheets sandwiching a core filled with extinguishant and a means of attaching the assembly in the desired location. The core may be completely hollow with the exception of extinguishant or have channels, a honeycomb or other configuration to give greater rigidity to the panel and to maintain the overall distribution of extinguishant. Thie extinguishant may be gaseous or a powder, or a mixture thereof. The two sheets sandwiching the core may also be of a brittle material designed to shatter upon impact to assure sufficient release of the enclosed extinguishant. The panels may also be adhesively attached in segments to the surfaces of the fuel tank. This device can satisfy all of the objects stated previously, whereas prior art cannot satisfy all of the objects in their entirety.

DETAILED DESCRIPTION

Figure 1:
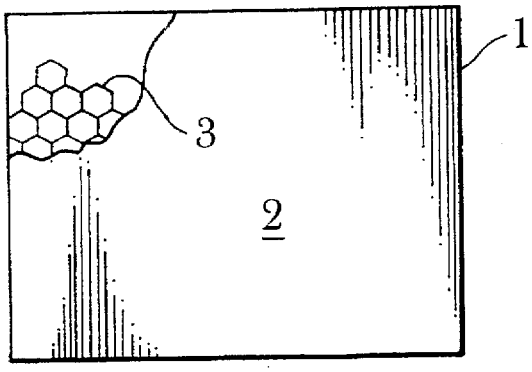
FIG. 1 is a top elevation and section in part of the entire device in accordance with the present Invention in the preferred embodiment.
Figure 2:
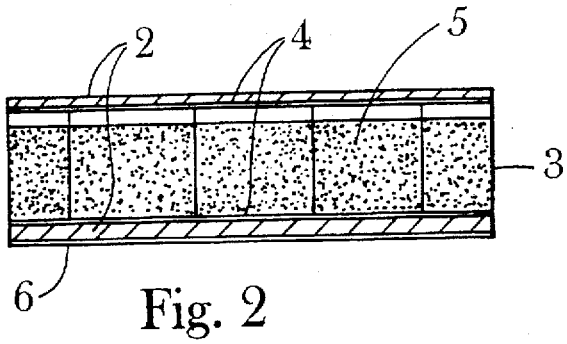
FIG. 2 is a side elevation and section of the preferred embodiment of the device in Fig. 1.
Figure 3:
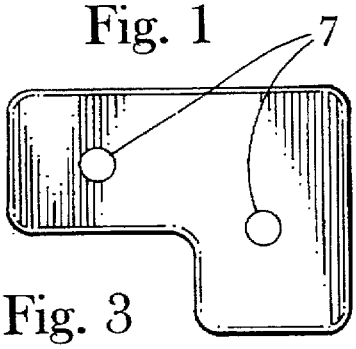
FIG. 3 is a top elevation of the present Invention contoured to fit a particular fuel tank with clearance holes for clearance of fuel tank fittings.
Figure 4:
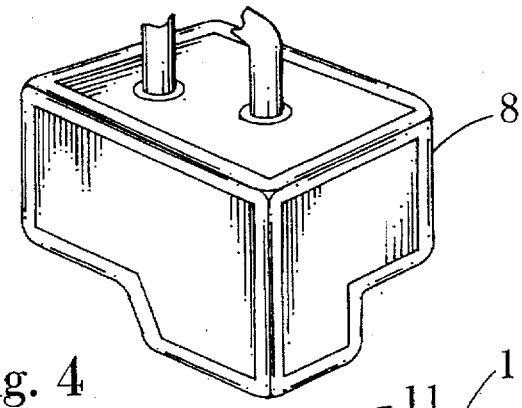
FIG. 4 is an isometric view of a highway vehicle fuel tank with typical panels in the configuration of the present Invention installed.
Figure 5:
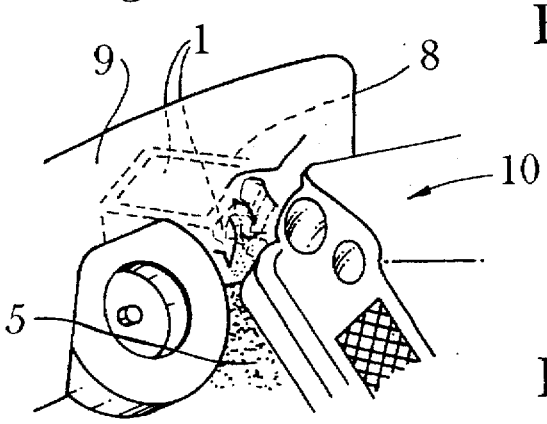
FIG. 5 is a diagrammic perspective view of a realistic crash incident involving impact of a highway vehicle and the fuel tank of another highway vehicle, and illustrating activation of the present Invention as installed to prevent or extingulish a resultant fire.
Figure 6:
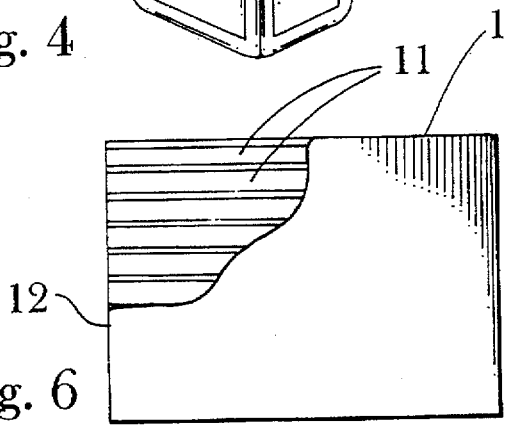
FIG. 6 is a top elevation and section of a variant to the preferred embodiment of the Invention utilizing linear channels in the panel core to give panel rigidity and control distribution in storage of the extinguishant.
Figure 7:
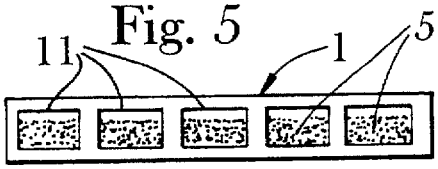
FIG. 7 is a side elevation and section of the device in FIG. 6.
Figure 8:
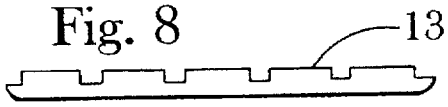
FIG. 8 is a side elevation of the end caps for the device in FIG. 7.
Figure 9:
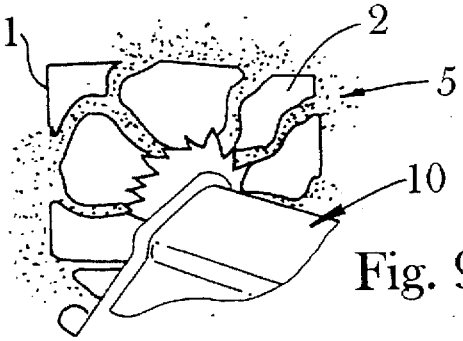
FIG. 9 is a diagrammic perspective view of a variant to the preferred embodiment of the Invention featuring shattering faces upon impact.

Refer now to FIG. 1, which is an overall drawing of the preferred embodiment of the Invention. The device 1, or powder panel, consists of two face sheets 2 attached on both faces of the honeycomb core 3. Said face sheets 2 can be made of many materials, including coated paper and plastic, but said face sheets 2 are constructed of industrial grade aluminum foil in the preferred embodiment. In construction one said face sheet 2 is bonded using epoxy 4 or a similar adhesive to said honeycomb 3, which is constructed from aluminum in the preferred embodiment. Said honeycomb 3 is then filled with extinguishing powder 5 such as potassium bicarbonate, mixed with an appropriate desiccant and flow enhancer such as a 1% concentration of micronized fuimed silica, in the preferred embodiment. Although the compartments of said honeycomb 3 are intended to be totally filled to capacity in construction, some settling may occur after construction and installation, leaving some void space in said honeycomb 3. Although said device 1 can be mounted using several different approaches, said device 1 is adhesively attached directly to the fuel tank in the preferred embodiment. An adhesive backing 6, possibly a doulble-sided adhesive, is attached to one face of said device 1; the other side of said adhesive backing 6 is attached directly to the exterior of the fuel tank after the adhesive protective film is removed to reveal the adhesive layer at the time of installation. Said device 1 can also be attached to other areas in proximity of the fuel tank, such as the inside of the vehicle body panels, and can be attached by other means such as screws, rivets, clips or other fasteners. In FIG. 3 said device 1 is cut or otherwise configured to conform to the shape of tie fuel tank in question. Clearance holes 7 to conform around fittings and exterior connections to the fuel tank are also made to facilitate installation. FIG. 4 illustrates the installation of said device 1 in the form of several panels, customized to conform to each of the faces of the fuel tank 8 as a kit and adhesively attached to said fuel tank 8 faces. If said fuel tank 8 sLIrface configuration is too complex for direct attachment, a variation to the preferred embodiment comprising a rigid structure of attached panels surrounding the exterior of said fuel tank 8 in close proximity may be required. FIG. 5 illustrates a realistic highway vehicle crash event that demonstrates the actual operation of said device 1. When a highway vehicle 9 equipped with said device 1 is impacted by a colliding vehicle 10, deforming the exterior of said highway vehicle 9 and said fuiel tank 8 with said device 1 attached to said fuel tank 8. When deformed and ruptured said device 1 releases extinoguislhant such as said extinguishant powder 5 (potassium bicarbonate in the preferred embodiment) to inert the surrounding area around said damaged and polentialiy leaking fuel tank 8 to prevent fire initiation or to extinguish it at its beginning stages. Other materials can be used for said dcvice 1 in the configuration of the preferred emnbodiment. Said panel faces 2 can be made from aluminum, cellulosic material such as paper, plastics, ceramics, nylon, glass fabric, fiberglass/epoxy, Kevlar, graphite tape, other composites or other lightweight and/or cost effective materials. Said honeycomb core 3 likewise can also be made of similarrigid materials or Nomex. Said device 1 can be cut, machined, stamped or otherwise formed to configure to the desired shapes. Other variations to said fire extinguishaint powder 5 ca be used, such as sodium bicarbonate, monoammnionium phosphate, urea-based powders, potassium dawsonite, ammonium polyphosphate, potassiumn iodide or other powder extinuishants or mixtures thereofi or gaseous agents such as nitmogen, carbon dioxide, argon, iodotrifluoromethane, heptafluoropropane, pentafluoroetlhane, or other gaseous agents or mixtures thereof Other variations to said epoxy 4 can be used to bond said panel faces 2 to said core 3, such as but lnot limited to hot glues and other chemical adhesives. The ends of said device 1 can be taped adhesively, glued or crimped if desired, and grommets can be installed in said clearance holes 7. Other variations to the preferred embodiment also exist. In FIG. 6, said device 1 is a one piece unit that has been extruded, cast, injection molded or manlufactured by some other means. Said device 1 can be a plastic or some other manufacturable material. Said device 1 has a series of hollow channels 11 in which powder or some other extinguishant is added. FIG. 7 illustrates said enclosed channels 11 with said powder 5 or other extinauishant installed. Although in the preferred embodiment the panel edges can be taped or otherwise sealed if desired, in this variation one edge 12 of the panel 1 will be open and have an end cap 13 configured to be snapped into the edge 12, as illustrated in FIG. 8. Said end cap 13 can be made of rubber or some other material to be pressed into the edge 12 of said device 1. Standing the device 1 upright and resting on the end cap 13 installed, said powder 5 or other extinguishant can be poured or injected into the channels, and when filled the other end cap 13 can be snapped into position, sealing the device 1. This variation has the potential of significant labor savings in assembly and potentially lower material costs. The device 1 can also be adhesively applied to the fuel tank. If said clearance holes 7 are necessary for this design, then grommets may be necessary to be snapped into said device 1 clearance holes 7. The material variations described in the preferred embodiment also apply to this variation.

Another variation is a material variation to either the configuration of the preferred embodiment or the prior variation. In this variation the material of said face sheets 2 and/or said core 3 are made of a brittle material such as glass or a boritile plastic that is designed to shatter upon impact, such as impact by said colliding vehicle 10. Said face sheets 2 completely shatter to assure total release of almost all said entire powder extinguishant 5 or other extinguishant contents rather than only the portion in the region of said device 1 that is damaged or exposed. This assures that plenty of said powder extinguishant 5 or other extinguishant is propelled to the potential fire site. Said honey comb core 3 or said hollow channels 11 may not be needed for such a variation. The material variations described in the preterred embodiment also apply to this variation. Another variation is to use bendable materials for the structure of the panels, so the device can be shaped and bent to fit various configurations.

There is thus described a novel highway vehicle fuel tank fire protection device, which meets all of its stated objectives and which overcomes the disadvantages of existing techniques.

The foregoing description of the preferred emnbodiment of the Invention has been presented for purposes of illustration and description. It is not intended to be exhaustive or limit the Invention to the precise forin disclosed. Many modifications and variations are possible in light of the above teaching. It is intended that the scope of the Invention be limited not by this detailed description, but rather by the claims appended hereto.

I claim:

1. A fire protection device for a vehicle, comprising:

a rigid container having a first surface and a second surface spaced from said first surface;

a plurality of internal channels located between said first surface and said second surface, and containing a fire extinguishing substance therein, said channels each having a first end and a second end, and a longitudinal axis oriented parallel to said first surface and said second surface;

whereby, upon deformation of said rigid container during a collision, said rigid container will be ruptured and said substance will be discharged to prevent or extinguish any fires generated as a result of the collision.

2. The device of claim 1, further comprising a plurality of end caps for sealing the ends of said plurality of internal channels.

3. The device of claim 2, wherein said plurality of end caps comprise one end cap for coving each of said first ends of said channels, and a one end cap for covering each of said second ends of said channels.

4. The device of claim 1, wherein at least one of said first surface and said second surface is sufficiently brittle to substantially shatter upon impact of an object therewith.

5. The device of claim 1, wherein said fire extinguishing substance is selected from the group consisting of potassium bicarbonate, monoammonium phosphate, ammonium polyphosphate, urea-based powder, potassium dawsonite, potassium iodide, iodotrifluoromethane, heptafluoromethane, pentafluoroethane, nitrogen, carbon dioxide, and a dessicant.

6. A fire protection device according to any of claims 1–5 in combination with a vehicle having a fuel tank, and further comprising, means for mounting said rigid container to said vehicle in proximity to said fuel tank.

* * * * *